US008670700B2

(12) United States Patent
Kuroda et al.

(10) Patent No.: US 8,670,700 B2
(45) Date of Patent: Mar. 11, 2014

(54) DEVELOPING ROLLER FOR ELECTROPHOTOGRAPHIC IMAGE FORMING

(75) Inventors: Kenichi Kuroda, Kobe (JP); Akihiko Kawatani, Kobe (JP); Masakazu Tanaka, Kobe (JP); Yoshihisa Mizumoto, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 13/559,987

(22) Filed: Jul. 27, 2012

(65) Prior Publication Data

US 2013/0089362 A1 Apr. 11, 2013

(30) Foreign Application Priority Data

Oct. 6, 2011 (JP) ..... 2011-222252

(51) Int. Cl.
*G03G 15/08* (2006.01)

(52) U.S. Cl.
USPC ..... 399/286

(58) Field of Classification Search
USPC ..... 399/286, 279, 119, 281
See application file for complete search history.

(56) References Cited

U.S. PATENT DOCUMENTS

| | | | |
|---|---|---|---|
| 5,084,733 | A | 1/1992 | Katoh et al. |
| 2003/0139270 | A1 | 7/2003 | Jung et al. |
| 2006/0056879 | A1 | 3/2006 | Jung et al. |
| 2008/0146427 | A1 | 6/2008 | Osaku |

FOREIGN PATENT DOCUMENTS

| | | | | | |
|---|---|---|---|---|---|
| JP | 60135966 | A | * | 7/1985 | ..... G03G 15/08 |
| JP | 63-98675 | A | | 4/1988 | |
| JP | 1-198778 | A | | 8/1989 | |
| JP | 08044193 | A | * | 2/1996 | ..... G03G 15/08 |
| JP | 9-329128 | A | | 12/1997 | |
| JP | 10-293453 | A | | 11/1998 | |
| JP | 2000-98731 | A | | 4/2000 | |
| JP | 2003-263021 | A | | 9/2003 | |
| JP | 2003-345088 | A | | 12/2003 | |
| JP | 2006-178100 | A | | 7/2006 | |
| JP | 2006-259246 | A | | 9/2006 | |
| JP | 2008-165214 | A | | 7/2008 | |
| JP | 2011-17968 | A | | 1/2011 | |

* cited by examiner

*Primary Examiner* — Billy Lactaoen
(74) *Attorney, Agent, or Firm* — Birch, Stewart, Kolasch & Birch, LLP

(57) ABSTRACT

A developing roller is provided, which is particularly used in an image forming apparatus of a highly durable design and is free from toner leakage even after formation of a predetermined number of images. Opposite end regions (5*a*) of an outer peripheral surface (5) of a roller body (2) of the developing roller (1) to be respectively kept in sliding contact with seal members each have a friction coefficient μ of not greater than 0.15.

6 Claims, 2 Drawing Sheets

DEVELOPING ROLLER FOR ELECTROPHOTOGRAPHIC IMAGE FORMING

TECHNICAL FIELD

The present invention relates to a developing roller to be used in an electrophotographic image forming apparatus such as a laser printer, an electrostatic copying machine, a plain paper facsimile machine or a printer-copier-facsimile multi-function machine.

BACKGROUND ART

In various electrophotographic image forming apparatuses, a developing roller and a charging blade (layer regulating blade) kept in press contact with an outer peripheral surface of the developing roller are used for developing an electrostatic latent image formed by exposing a surface of an electrically charged photoreceptor drum into a toner image.

That is, when the developing roller is rotated in press contact with the charging blade, toner is electrically charged. The electrically charged toner adheres to the outer peripheral surface of the developing roller and, at the same time, the amount of the toner adhering to the outer peripheral surface is regulated by the charging blade. Thus, a toner layer having a generally even thickness is formed on the generally entire outer peripheral surface of the developing roller.

In this state, the developing roller is further rotated to transport the toner layer to the vicinity of the surface of the photoreceptor drum. Then, the toner of the toner layer is selectively transferred onto the surface of the photoreceptor drum according to the electrostatic latent image formed on the surface of the photoreceptor drum. Thus, the electrostatic latent image on the surface of the photoreceptor drum is developed into the toner image.

The developing roller typically includes a roller body, and at least an outer peripheral surface of the roller body is formed of a semiconductive rubber (see Patent Literature 1).

Opposite ends of the outer peripheral surface of the roller body of the developing roller are respectively sealed with seal members to prevent toner adhering to the outer peripheral surface from leaking out from the ends. The seal members are made of, for example, a felt material, and fixed to a housing or the like of the image forming apparatus in sliding contact with the opposite ends of the outer peripheral surface of the roller body of the rotating developing roller.

In an image forming apparatus of a highly durable design requiring maintenance service after every time about 8000 images are formed, the toner is liable to leak from the opposite ends of the developing roller (that should have successfully been sealed with the seal members) before the first maintenance service after the start of the use of the apparatus. This occurs supposedly because opposite end portions of the outer peripheral surface of the roller body are worn due to the sliding contact with the seal members to create gaps between the seal members and the opposite ends of the outer peripheral surface.

Patent Literature 2 discloses that substantially the entire outer peripheral surface of the roller body is coated with a resin coating layer such as of a fluororesin or a silicone resin for stabilization of toner chargeability. The provision of the resin coating layer is expected to suppress the wear of the opposite end portions of the outer peripheral surface of the roller body which may otherwise occur due to the sliding contact with the seal members.

However, the resin coating layer is generally designed to have a friction coefficient μ of about 0.25 to about 0.5 in consideration of the balance of frictional force between the toner and the resin coating layer. Therefore, the resin coating layer has an insufficient wear resistance. Particularly, where the developing roller is used in the image forming apparatus of the highly durable design, it is impossible to prevent the leakage of the toner from occurring before the predetermined number of images are formed. Where the entire outer peripheral surface of the roller body is coated with the resin coating layer, the friction coefficient μ of the resin coating layer cannot be set at less than 0.25. This is because the developing performance of the developing roller is deteriorated.

CITATION LIST

Patent Literature

PATENT LITERATURE 1: JP-2003-345088-A
PATENT LITERATURE 2: JP-2008-165214-A

SUMMARY OF THE INVENTION

Technical Problem

It is an object of the present invention to provide a developing roller which is used in an image forming apparatus, particularly in an image forming apparatus of a highly durable design, and is free from toner leakage even after a predetermined number of images are formed.

Solution to Problem

According to the present invention, there is provided a developing roller for use in an electrophotographic image forming apparatus, the developing roller comprising a roller body extending in a rotation axis direction thereof and having a cylindrical outer peripheral surface, wherein opposite end regions of the outer peripheral surface of the roller body with respect to the rotation axis direction each have a friction coefficient μ of not greater than 0.15.

In the present invention, the opposite end regions of the outer peripheral surface of the roller body of the developing roller to be respectively kept in sliding contact with seal members each have a friction coefficient μ of not greater than 0.15 as described above and, therefore, have higher wear resistance. Even if a predetermined number of images are formed, for example, with the developing roller incorporated in an image forming apparatus of a highly durable design, the leakage of the toner can be prevented which may otherwise occur due to gaps formed between the opposite end regions and the seal members.

The friction coefficient μ of the opposite end regions can be efficiently controlled at not greater than 0.15 by a smaller number of steps simply by irradiating the opposite end regions of the outer peripheral surface with ultraviolet radiation or by coating the opposite end regions of the outer peripheral surface with a lower-friction coating layer.

Effects of the Invention

The developing roller according to the present invention is used in an image forming apparatus of a highly durable design, and is free from toner leakage even after formation of a predetermined number of images.

DESCRIPTION OF EMBODIMENTS

Figure 1:
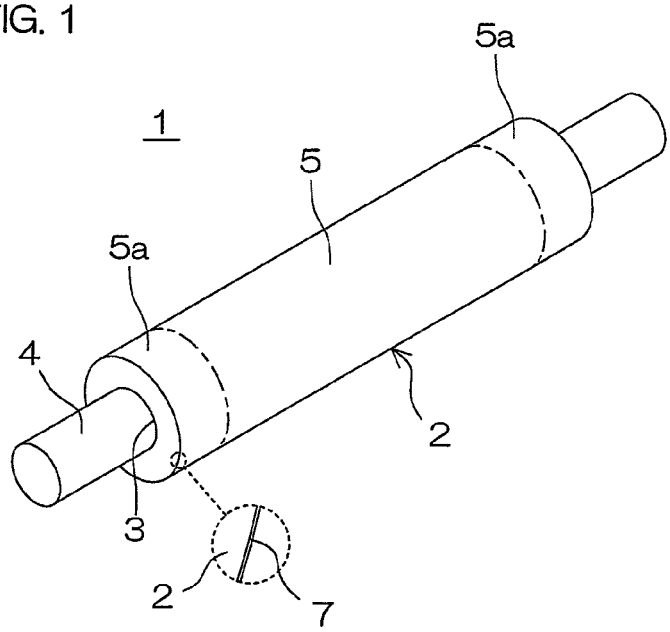
FIG. 1 is a perspective view illustrating a developing roller according to one embodiment of the present invention.

FIG. 1 is a perspective view illustrating a developing roller according to one embodiment of the present invention.

Referring to FIG. 1, the developing roller 1 of this embodiment includes a hollow cylindrical roller body 2, and a shaft 4 inserted in a center hole 3 of the roller body 2.

The roller body 2 may be nonporous, or may be porous. The roller body 2 may have a single layer structure, or may have a double layer structure including an outer layer disposed adjacent the outer peripheral surface 5 and an inner layer disposed adjacent the shaft 4.

In order to simplify the structure of the developing roller 1 to produce the developing roller 1 at lower costs with higher productivity, it is preferred that the roller body 2 basically has a single layer structure as shown in FIG. 1.

The shaft 4 is an elongated cylindrical body made of a metal such as aluminum, an aluminum alloy or stainless steel. The shaft 4 may have an hollow inside. The roller body 2 and the shaft 4 are electrically connected to each other and mechanically fixed to each other with an electrically conductive adhesive agent for unitary rotation.

The roller body 2 is preferably made of, for example, a semiconductive rubber composition or the like.

More specifically, the semiconductive rubber composition is prepared by blending together a rubber component containing at least an ion conductive rubber, a crosslinking component for crosslinking the rubber component, and other additives. Then, the semiconductive rubber composition is formed into a tubular shape, for example, by an extrusion method, and cured by a crosslinking reaction of the rubber component. As required, an outer peripheral surface 5 is polished. Thus, the roller body 2 is produced.

It is noted that the developing roller 1 may include a cylindrical roller body 2 alone without the provision of the shaft 4.

(Ion Conductive Rubber)

By blending the ion conductive rubber as the rubber component, the roller body 2 is imparted with ion conductivity, and the roller resistance value of the roller body 2 is controlled within a proper range. Thus, toner can be electrically charged at a proper charge amount in a developing process.

That is, the toner can be electrically charged at a charge amount that is suitable for developing an electrostatic latent image formed on a surface of a photoreceptor drum when the developing roller 1 including the robber body 2 is rotated in press contact with a charging blade.

An example of the ion conductive rubber is an epichlorohydrin rubber. Any of various polymers containing epichlorohydrin as a recurring unit may be used as the epichlorohydrin rubber.

Examples of the epichlorohydrin rubber include epichlorohydrin homopolymers, epichlorohydrin-ethylene oxide bipolymers, epichlorohydrin-propylene oxide bipolymers, epichlorohydrin-allyl glycidyl ether bipolymers, epichlorohydrin-ethylene oxide-allyl glycidyl ether terpolymers, epichlorohydrin-propylene oxide-allyl glycidyl ether terpolymers and epichlorohydrin-ethylene oxide-propylene oxide-allyl glycidyl ether quaterpolymers, which may be used either alone or in combination.

Particularly, the ethylene oxide-containing copolymers are preferred as the epichlorohydrin rubber, and such an ethylene oxide-containing copolymer preferably has an ethylene oxide content of 30 to 95 mol %, more preferably 55 to 95 mol %, particularly preferably 60 to 80 mol %.

Ethylene oxide functions to reduce the electrical resistance. If the ethylene oxide content is less than the aforementioned range, an electrical resistance reducing effect is reduced. On the other hand, if the ethylene oxide content is greater than the aforementioned range, ethylene oxide is more liable to be crystallized, whereby the segment motion of molecular chains is hindered to increase the electrical resistance. Further, there are possibilities that the roller body has a higher hardness after the crosslinking, and the semiconductive rubber composition has a higher viscosity when being heat-melted before the crosslinking.

Particularly, the epichlorohydrin-ethylene oxide bipolymers (ECO) are preferred as the epichlorohydrin rubber.

Such an ECO preferably has an ethylene oxide content of 30 to 80 mol %, particularly preferably 50 to 80 mol %, and preferably has an epichlorohydrin content of 20 to 70 mol %, particularly preferably 20 to 50 mol %.

The epichlorohydrin-ethylene oxide-ally glycidyl ether terpolymers (GECO) are also usable as the epichlorohydrin rubber.

Such a GECO preferably has an ethylene oxide content of 30 to 95 mol %, particularly preferably 60 to 80 mol %, and preferably has an epichlorohydrin content of 4.5 to 65 mol %, particularly preferably 15 to not less than 40 mol %. Further, the GECO preferably has an allyl glycidyl ether content of 0.5 to 10 mol %, particularly preferably 2 to 6 mol %.

Examples of the GECO include copolymers of the three comonomers described above in a narrow sense, as well as known modification products obtained by modifying the epichlorohydrin-ethylene oxide copolymers (ECO) with allyl glycidyl ether. In the present invention, any of these copolymers are usable.

(Other Rubbers for Rubber Component)

The rubber component for the roller body may contain a styrene-butadiene rubber (SBR) and a polar rubber in addition to the ion conductive rubber.

Particularly, the SBR has a lower electrical resistance and, therefore, reduces the proportion of the ion conductive rubber required for the formation of the roller body having the same roller resistance value.

Usable as the SBR are various SBRs synthesized by copolymerizing styrene and 1,3-butadiene by an emulsion polymerization method, a solution polymerization method, and the like. The SBRs include those of an oil-extension type having flexibility controlled by addition of an extension oil, and those of a non-oil-extension type containing no extension oil. Either type of SBR is usable.

According to the styrene content, the SBRs are classified into a higher styrene content type, an intermediate styrene content type and a lower styrene content type. Any of these types of SBRs is usable. Physical properties of the roller body can be controlled by changing the styrene content and the crosslinking degree.

These SBRs may be used either alone or in combination.

Examples of the polar rubber include chloroprene rubbers (CR), nitrile rubbers (NBR), butadiene rubbers (BR) and acryl rubbers (ACM), which may be used either alone or in combination. Particularly, the chloroprene rubbers and the nitrile rubbers are preferred. By blending the polar rubber, the roller resistance value of the roller body can be finely controlled.

(Combination and Proportions of Rubbers for Rubber Component)

For example, a combination (a) of three rubbers including the ion conductive rubber, the SBR and the polar rubber and a combination (b) of two rubbers including the ion conductive rubber and the polar rubber are preferred.

In the case of the combination (a) of the three rubbers, the proportion of the ion conducive rubber is preferably not less than 5 mass % and not greater than 40 mass % based on the overall amount of the rubber component. The proportion of the SBR is preferably not less than 5 mass % and not greater than 80 mass % based on the overall amount of the rubber component.

The proportion of the polar rubber is the balance of the rubber component, excluding the ion conductive rubber and the SBR. The proportion of the polar rubber is adjusted so that the total amount of the SBR, the ion conductive rubber and the polar rubber is 100 mass %. Where two or more types of polar rubbers are used in combination, the total amount of the polar rubbers falls within the aforementioned range.

In the case of the combination (a), the proportion of the ion conductive rubber is limited to the aforementioned range. If the proportion of the ion conductive rubber is less than 5 mass %, the roller resistance value is increased and, when the roller body is used for the developing roller, the toner charge amount is liable to be reduced. If the proportion of the ion conductive rubber is greater than 40 mass %, the toner is more liable to adhere to the roller body when the roller body is used for the developing roller, thereby reducing the image density of a formed image.

In the case of the combination (b) of the two rubbers, the proportion of the ion conductive rubber is preferably not less than 10 mass % and not greater than 60 mass % based on the overall amount of the rubber component.

The proportion of the polar rubber is the balance of the rubber component, excluding the ion conductive rubber. The proportion of the polar rubber is adjusted so that the total amount of the ion conductive rubber and the polar rubber is 100 mass %. Where two or more types of polar rubbers are used in combination, the total amount of the polar rubbers falls within the aforementioned range.

In the case of the combination (b), the proportion of the ion conductive rubber is limited to the aforementioned range. If the proportion of the ion conductive rubber is less than 10 mass %, the roller resistance value is increased and, when the roller body is used for the developing roller, the toner charge amount is liable to be reduced. If the proportion of the ion conductive rubber is greater than 60 mass %, the toner is more liable to adhere to the roller body when the roller body is used for the developing roller, thereby reducing the image density of a formed image.

(Crosslinking Component)

The crosslinking component includes a crosslinking agent.

Examples of the crosslinking agent include sulfur crosslinking agents, thiourea crosslinking agents, triazine derivative crosslinking agents, peroxide crosslinking agents and various monomers, which may be used either alone or in combination.

Examples of sulfur crosslinking agents include sulfur powder and organic sulfur-containing compounds. Examples of the organic sulfur-containing compounds include tetramethylthiuram disulfide and N,N-dithiobismorpholine.

Examples of the thiourea crosslinking agents include tetramethylthiourea, trimethylthiourea, ethylene thiourea, and thioureas represented by $(C_nH_{2n+1}NH)_2C{=}S$ (wherein n is an integer of 1 to 10).

Examples of the peroxide crosslinking agents include benzoyl peroxide and the like.

Depending on the type of the crosslinking agent, an accelerating agent and an acceleration assisting agent may be blended in the rubber composition.

Examples of the accelerating agent include inorganic accelerating agents such as lime, magnesia (MgO) and litharge (PbO), and the following organic accelerating agents, which may be used either alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used either alone or in combination.

Different types of accelerating agents have different functions and, therefore, are preferably used in combination.

Examples of the acceleration assisting agent include: metal compounds such as zinc white; fatty acids such as stearic acid, oleic acid and cotton seed fatty acids; and other conventionally known acceleration assisting agents, which may be used either alone or in combination.

The proportions of the crosslinking agent, the accelerating agent and the acceleration assisting agent to be blended are properly determined according to the combination and proportions of the rubbers for the rubber component, and the types and combination of the crosslinking agent, the accelerating agent and acceleration assisting agent.

(Other Components)

The roller body 2 may be imparted with electrical conductivity by blending electrically conductive carbon black in the semiconductive rubber composition. If an excessively great amount of the electrically conductive carbon black is blended, however, the roller body is liable to have an uneven roller resistance with significant variations. Therefore, the proportion of the electrically conductive carbon black is preferably not less than 1 part by mass and not greater than 5 parts by mass, particularly preferably not greater than 3 parts by mass, based on 100 parts by mass of the rubber component.

As required, an acid accepting agent, a filler and the like may be blended in the semiconductive rubber composition.

In the presence of the acid accepting agent, chlorine-containing gases generated from the epichlorohydrin rubber during the crosslinking of the rubber component is prevented from remaining in the roller body. Thus, the acid accepting agent functions to prevent the inhibition of the crosslinking and the contamination of the photoreceptor, which may otherwise occur due to the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where any of the hydrotalcites is used in combination with magnesium oxide or potassium oxide, a higher acid accepting effect can be provided, thereby more advantageously preventing the contamination of the photoreceptor.

The proportion of the acid accepting agent to be blended is preferably not less than 0.2 parts by mass and not greater than 10 parts by mass, particularly preferably not less than 1 part by mass and not greater than 5 parts by mass, based on 100 parts by mass of the rubber component.

If the proportion of the acid accepting agent is less than the aforementioned range, the effect described above may be insufficient even with the acid accepting agent blended. If the proportion of the acid accepting agent is greater than the aforementioned range, the roller body is liable to have an increased hardness after the crosslinking.

Examples of the filler include zinc oxide, silica, carbon, carbon black, clay, talc, calcium carbonate, magnesium carbonate, aluminum hydroxide and titanium oxide, which may be used either alone or in combination.

The blending of the filler makes it possible to properly control the rubber hardness of the roller body and to improve the mechanical strength of the roller body.

The proportion of the filler to be blended is preferably not greater than 50 parts by mass, particularly preferably not greater than 10 parts by mass, based on 100 parts by mass of the rubber component.

The semiconductive rubber composition containing the aforementioned components can be prepared in a conventional manner. First, the rubbers for the rubber component are blended in the predetermined proportions, and the resulting rubber component is simply kneaded. After additives other than the crosslinking component are added to and kneaded with the rubber component, the crosslinking component is finally added to and further kneaded with the resulting mixture. Thus, the semiconductive rubber composition is provided. A kneader, a Banbury mixer, an extruder and the like, for example, are usable for the kneading.

(Developing Roller 1)

A roller body 2 is produced from the semiconductive rubber composition described above in the aforementioned manner, and electrically connected to and mechanically fixed to a shaft 4 with an electrically conductive adhesive agent. Then, axially opposite end regions 5*a* of an outer peripheral surface 5 of the roller body 2 (outer peripheral surface portions defined by one-dot-and-dash lines in FIG. 1) to be kept in sliding contact with seal members (not shown) are treated so as to have a friction coefficient μ of not greater than 0.15. Thus, the inventive developing roller 1 is produced.

The treatment is performed by: (1) irradiating the opposite end regions 5*a* of the outer peripheral surface 5 with ultraviolet radiation; or (2) coating the opposite end regions 5*a* with a lower-friction coating layer.

Figure 2:
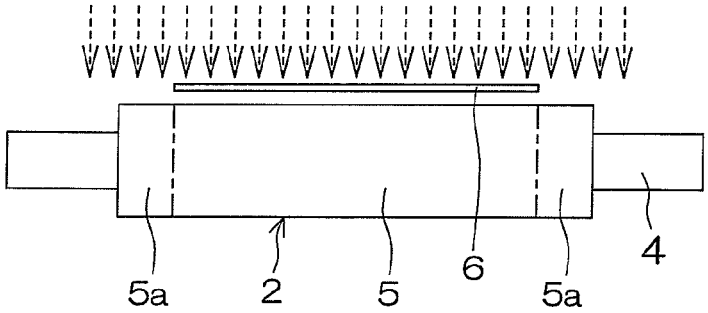
FIG. 2 is a diagram for explaining a process for selectively irradiating opposite end regions of a roller body of the developing roller of FIG. 1 with ultraviolet radiation.

FIG. 2 is a diagram for explaining the process (1) for treating the opposite end regions 5*a* by the irradiation with ultraviolet radiation.

Referring to FIGS. 1 and 2, a shield plate 6 for blocking the ultraviolet radiation is disposed between the roller body 2 and an ultraviolet radiation source (UV lamp) not shown in this process. The shield plate 6 is dimensioned so that only the opposite end regions 5*a* of the outer peripheral surface 5 of the roller body 2 are exposed to the UV lamp and the other region of the outer peripheral surface 5 is shielded from the UV lamp.

Then, the roller body 2 is rotated about a center axis of the shaft 4 circumferentially of the outer peripheral surface 5, for example, by 90 degrees at each time. After each 90-degree rotation, a part of the roller body 2 opposed to the UV lamp is irradiated with the ultraviolet radiation emitted from the UV lamp for a predetermined period of time as indicated by broken line arrows in FIG. 2.

Thus, only the opposite end regions 5*a* of the outer peripheral surface 5 of the roller body 2 not shielded with the shield plate 6 but exposed are irradiated with the ultraviolet radiation, whereby the semiconductive rubber in the opposite end regions 5*a* are oxidized. Thus, an oxide film 7 (see FIG. 1) is formed to reduce the friction coefficient μ of the opposite end regions 5*a*.

In order to efficiently oxidize the semiconductive rubber, it is preferred that the wavelength of the ultraviolet radiation for the irradiation is not shorter than 200 nm and not longer than 400 nm, particularly not longer than about 300 nm. Particularly, the semiconductive rubber can be efficiently oxidized by irradiation with 2 or more types of ultraviolet radiations having different wavelengths within the aforementioned wavelength range.

In the aforementioned process, the UV irradiation period may be properly controlled to reduce the friction coefficient μ of the opposite end regions 5*a* to not greater than 0.15. That is, the friction coefficient μ of the opposite end regions 5*a* is reduced as the irradiation period is increased.

Specifically, the irradiation period is not particularly limited, because the irradiation period varies depending on the dose of the ultraviolet radiation per unit time. The irradiation period is preferably not shorter than 8 minutes and not longer than 30 minutes, particularly preferably not shorter than 10 minutes and not longer than 15 minutes.

If the irradiation period is shorter than the aforementioned range, it is impossible to reduce the friction coefficient μ of the opposite end regions 5*a* to not greater than 0.15. If the irradiation period is longer than the aforementioned range, a longer period of time is required for the process, thereby reducing the productivity of the developing roller 1.

Figure 3:
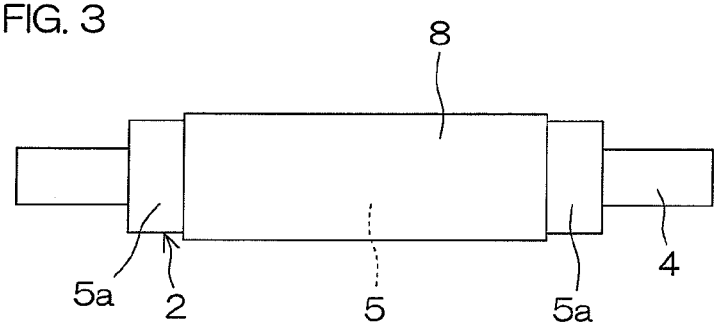
FIG. 3 is a diagram for explaining a process for selectively coating the opposite end regions of the roller body of the developing roller of FIG. 1 with a lower-friction coating layer.

FIG. 3 is a diagram for explaining the process (2) for coating the opposite end regions 5 with a coating layer.

Referring to FIGS. 1 and 3, the opposite end regions 5*a* of the outer peripheral surface 5 of the roller body 2 are unmasked, and the other region of the outer peripheral surface 5 is masked with a masking member 8. The masking member 8 may be provided, for example, by wrapping the other region of the outer peripheral surface 5 with a masking tape, by applying a masking agent on the other region of the outer peripheral surface 5, or by fitting a tubular member having an inner diameter substantially equal to the outer diameter of the roller body 2 around the other region of the outer peripheral surface 5.

In turn, the roller body 2 is rotated about the shaft 4 circumferentially of the outer peripheral surface 5 at constant speed, while a coating agent for the coating layer is applied over the opposite end regions 5*a* of the outer peripheral surface 5, for example, by a spray coating method or the like. Then, the coating agent is dried.

Subsequently, the masking member 8 is removed. Thus, the coating layer 7 (see FIG. 1) is formed as covering only the opposite end regions 5*a*, whereby the friction coefficient μ of the opposite end regions 5*a* is selectively reduced. The thickness of the coating layer 7 may be controlled at any proper thickness.

As the coating agent to be used for the formation of the coating layer 7, a coating agent capable of forming a coating layer having a friction coefficient μ of not greater than 0.15 is selected from various coating agents containing resins, such as fluororesins and silicone resins, intrinsically capable of forming a lower-friction coating layer.

Usable as the coating agent is Emralon (registered trade name) T-861 (fluororesin) available from Henkel Japan Ltd. by way of example but not by way of limitation.

The inventive developing roller 1 in which the opposite end regions 5*a* to be respectively kept in sliding contact with the seal members are each imparted with higher friction resistance than in the prior art with their friction coefficient μ being set at not greater than 0.15 is free from the leakage of the toner which may otherwise occur due to gaps formed between the opposite end regions 5*a* and the seal members when a predetermined number of images are formed in an image forming apparatus of a higher durability design.

The lower limit of the friction coefficient μ of the opposite end regions 5*a* is not particularly limited, but is preferably not less than 0.05, particularly preferably not less than 0.09. It is difficult to reduce the friction coefficient μ of the surface of the semiconductive rubber or the surface of the coating layer to less than the aforementioned range. This may reduce the productivity of the developing roller 1.

The region (developing function region) of the outer peripheral surface 5 other than the opposite end regions 5*a* may be untreated, or may be treated so that the surface friction coefficient μ of the other portion is finely controlled to not less than 0.25.

In order to form a toner layer having an even thickness on the outer peripheral surface 5 in the developing process described above, it is desirable that the developing function region of the outer peripheral surface 5 other than the opposite end regions 5*a* has a moderate frictional force with respect to the toner and has a friction coefficient μ of not less than 0.25.

In this embodiment, the developing function region can have a friction coefficient μ of not less than 0.25 even if being untreated.

On the other hand, where the friction coefficient μ of the developing function region is controlled within the range not less than 0.25 by the irradiation with the ultraviolet radiation, for example, the UV irradiation period may be set shorter than that for the opposite end regions 5*a*, or the dose of the ultraviolet radiation per unit time may be set less than that for the opposite end regions 5*a*. Where the friction coefficient μ of the developing function region is controlled by coating the developing function region with a coating layer, a coating agent capable of forming a coating layer having a friction coefficient μ of not less than 0.25 may be selectively employed for the formation of the coating layer.

In the present invention, the friction coefficient μ of the opposite end regions 5*a* of the outer peripheral surface 5 and the friction coefficient μ of the other region (developing function region) of the outer peripheral surface 5 are each expressed by a value determined in the following manner at a temperature of 23±1° C. at a relative humidity of 55±1%.

Figure 4:
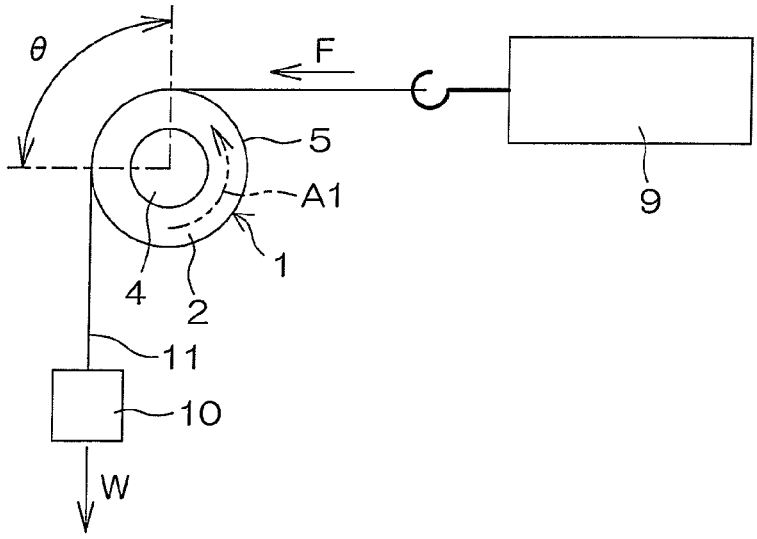
FIG. 4 is a diagram for explaining a method of measuring the friction coefficient μ of the opposite end regions of the roller body.

Referring to FIGS. 1 and 4, the developing roller 1 to be subjected to measurement of the friction coefficients μ of the opposite end regions 5*a* and the like is held rotatably in an arrow direction A1 indicated by a two-dot-and-dash line in FIG. 4 with the shaft 4 thereof directed horizontally. Further, a load meter 9 is located so as to be spaced a predetermined distance from the center axis of the developing roller 1.

Subsequently, an OHP film 11 cut to a size smaller than the width of the opposite end regions 5*a* as measured along the axis of the developing roller 1 is prepared. Then, one end of the OHP film 11 is connected to the load meter 9, and a weight 10 having a mass W (=20 g) is attached to the other end of the OHP film 11. In turn, the OHP film 11 is brought into contact with one of the opposite end regions 5*a* and the like of the outer peripheral surface 5 of the roller body 2 of the developing roller 1 to be subjected to the measurement of the friction coefficient μ.

At this time, a portion of the OHP film 11 extending between the developing roller 1 and the load meter 9 is kept horizontal, and a portion of the OHP film 11 extending from the developing roller 1 to the weight 10 is suspended vertically. Thus, the OHP film is kept in contact with a part of the end region 5*a* or the like of the outer peripheral surface 5 of the roller body 2 having a contact angle θ (=90 degrees) about the center axis of the shaft 4 to be subjected to the measurement of the friction coefficient μ.

In this state, a load F (g) occurring when the developing roller 1 is rotated at a predetermined speed in the arrow direction A1 indicated by the two-dot-and-dash line is measured by means of the load meter 9, and the friction coefficient μ is calculated based on the load F (g), the mass W (g) of the weight 10 and the contact angle θ (degree) from the following expression (i):

$$\mu=(1/\theta)\ln(F/W) \quad \text{(i)}$$

EXAMPLES

Example 1

(Preparation of Semiconductive Rubber Composition)

A rubber component was prepared by blending 70 parts by mass of SBR (JSR1502 available from JSR Corporation), 20 parts by mass of ECO (EPICHLOMER (registered trade name) D available from Tosoh Corporation and having an ethylene oxide content of 61 mol %) and 10 parts by mass of CR (SHOPRENE (registered trade name) WRT available from Showa Denko K.K.)

While 100 parts by mass of the rubber component was simply kneaded by a Banbury mixer, ingredients shown below in Table 1 except for a crosslinking component were added to and kneaded with the rubber component. Then, the crosslinking component was added to and kneaded with the resulting mixture. Thus, a semiconductive rubber composition was prepared.

TABLE 1

| Ingredients | Parts by mass |
|---|---|
| Ethylene thiourea | 0.5 |
| 5% oil-containing sulfur | 1.2 |
| Accelerating agent DT | 0.43 |
| Accelerating agent DM | 0.2 |
| Accelerating agent TS | 0.5 |
| Zinc white | 5 |
| Electrically conductive carbon black | 2 |
| Hydrotalcites | 3 |

The ingredients shown in Table 1 will be detailed below:

Ethylene thiourea: Crosslinking agent available under ACCEL (registered trade name) 22-S from Kawaguchi Chemical Industry Co., Ltd.

5% Oil-containing sulfur: Crosslinking agent available from Tsurumi Chemical Industry Co., Ltd.

Accelerating agent DT: 1,3-Di-o-tolylguanidine available under NOCCELER (registered trade name) DT from Ouchi Shinko Chemical Industrial Co., Ltd.

Accelerating agent DM: Di-2-benzothiazolyl disulfide available under NOCCELER DM from Ouchi Shinko Chemical Industrial Co., Ltd.

Accelerating agent TS: Tetramethylthiuram monosulfide available under NOCCELER TS from Ouchi Shinko Chemical Industrial Co., Ltd.

Zinc white: Acceleration assisting agent available under ZINC OXIDE TYPE-2 from Mitsui Mining & Smelting Co., Ltd.

Electrically conductive carbon black: Available under DENKA BLACK (registered trade name) from Denki Kagaku Kogyo K.K.

Hydrotalcites: Acid accepting agent available under DHT-4A (registered trade name) 2 from Kyowa Chemical Industry Co., Ltd.

The amounts (parts by mass) of the ingredients shown in Table 1 are based on 100 parts by mass of the rubber component.

(Production of Developing Roller)

The semiconductive rubber composition was fed into an extruder and then extruded into a hollow cylindrical shape having an outer diameter of 22 mm and an inner diameter of 7.0 mm. Then, the resulting cylindrical body was fitted around a temporary crosslinking shaft, and crosslinked at 160° C. for 1 hour in a vulcanization can.

Subsequently, the cylindrical body was removed from the temporary shaft, then fitted around a shaft having an outer diameter of 7.5 mm and an outer peripheral surface to which an electrically conductive thermosetting adhesive agent was applied, and heated to 160° C. in an oven. Thus, the cylindrical body was fixed to the shaft. Thereafter, opposite end portions of the cylindrical body were trimmed, and the outer peripheral surface of the cylindrical body was polished by a traverse polishing process utilizing a cylindrical polisher and then by a mirror polishing process to be thereby finished as having an outer diameter of 20.00 mm (with a tolerance of 0.05). Thus, a roller body combined with the shaft was produced.

(UV Irradiation Process)

Referring to FIGS. 1 and 2, the polished outer peripheral surface of the roller body 2 was rinsed with water, and the roller body was set in a UV irradiation apparatus (PL21-200 available from Sen Lights Corporation). A shield plate 6 for blocking ultraviolet radiation was placed between the roller body 2 thus set and an ultraviolet radiation source (UV lamp) not shown. The shield plate 6 was dimensioned so that the opposite end regions 5*a* of the outer peripheral surface 5 of the roller body 2 were exposed to the UV lamp and the other region of the outer peripheral surface 5 was shielded from the UV lamp. Further, a distance between the outer peripheral surface of the roller body 2 and the UV lamp was set to 10 cm. Then, the roller body 2 was rotated about the shaft 4 circumferentially of the outer peripheral surface 5 by 90 degrees at each time. After each 90-degree rotation, a part of the roller body 2 opposed to the UV lamp was irradiated with the ultraviolet radiation emitted at wavelengths of 184.9 nm and 253.7 nm from the UV lamp for 10 minutes as indicated by the broken line arrows in FIG. 2. Thus, an oxide film 7 was formed in the opposite end regions 5*a*, whereby a developing roller 1 was produced.

The opposite end regions 5*a* of the developing roller 1 each had a friction coefficient of 0.15 as measured by the method previously described. A developing function region of the outer peripheral surface 5 other than the opposite end regions 5*a* had a friction coefficient of 0.84 as measured in the same manner. A Digital force gage Model PPX-2T available from Imada Co., Ltd. was used as the load meter 9.

Comparative Example 1

A developing roller 1 was produced in substantially the same manner as in Example 1, except that no oxide film 7 was formed on the opposite end regions 5*a* of the roller body 2 by the irradiation with the ultraviolet radiation.

The opposite end regions 5*a* and the developing function region of the outer peripheral surface 5 of the roller body 2 each had a friction coefficient of 0.84.

Example 2 and Comparative Examples 2 and 3

Developing rollers 1 were each produced in substantially the same manner as in Example 1, except that the UV irradiation periods during which the opposite end regions 5*a* of the roller body 2 were irradiated with the ultraviolet radiation after each rotation of the roller body 2 was set to 1 minute (Comparative Example 2), 5 minutes (Comparative Example 3) and 15 minutes (Example 2).

The friction coefficients of the opposite end regions 5*a* of the outer peripheral surfaces 5 of the roller bodies 2 were 0.71 (Comparative Example 2), 0.17 (Comparative Example 3) and 0.09 (Example 2). The friction coefficients of the developing function regions of the outer peripheral surfaces 5 other than the opposite end regions 5*a* were 0.84 in Example 2 and Comparative Examples 2 and 3.

Example 3

Instead of the irradiation of the opposite end regions 5*a* of the roller body 2 with the ultraviolet radiation, a coating layer was formed in the following manner.

Referring to FIGS. 1 and 3, the opposite end regions 5*a* of the outer peripheral surface 5 of the roller body 2 were unmasked, and the other region (developing function region) of the outer peripheral surface 5 was masked with a masking member 8.

In turn, the roller body 2 was rotated about the shaft 4 circumferentially of the outer peripheral surface 5 at a constant speed, while a coating agent for the coating layer (Emralon (registered trade name) T-861 (fluororesin) available from Henkel Japan Ltd.) was applied over the opposite end regions 5*a* of the outer peripheral surface 5 by a spray coating method. Then, the coating agent is dried.

Subsequently, the masking member 8 is removed. Thus, a developing roller 1 was produced with its opposite end regions 5*a* selectively coated with the coating layer 7.

The opposite end regions 5*a* of the developing roller 1 had a friction coefficient of 0.10 as measured by the aforementioned method. The developing function region of the outer peripheral surface 5 not coated with the coating layer 7 had a friction coefficient of 0.84 as measured by the aforementioned method.

<Wear Resistance Evaluation>

The developing rollers 1 produced in Examples and Comparative Examples were each incorporated in a laser printer (HL-5340D available from Brother Industries, Ltd.), and a continuous 8000-sheet conveying test was performed with felt seal members of the printer kept in sliding contact with the opposite end regions 5*a*.

After the test, a developing section of the printer was observed to check if the toner leakage from the opposite end regions 5*a* occurs, and the developing roller was evaluated based on the following criteria:

o: No toner leakage was observed.

x: Toner leakage was observed.

The evaluation results are shown in Table 2.

TABLE 2

| | Comparative Example 1 | Comparative Example 2 | Comparative Example 3 | Example 1 | Example 2 | Example 3 |
|---|---|---|---|---|---|---|
| Treatment | | | | | | |
| UV irradiation period (min) | — | 1 | 5 | 10 | 15 | — |
| Coating layer | Absent | Absent | Absent | Absent | Absent | Present |
| Friction coefficient | | | | | | |
| Opposite end regions | 0.84 | 0.71 | 0.17 | 0.15 | 0.09 | 0.10 |
| Other region | 0.84 | 0.84 | 0.84 | 0.84 | 0.84 | 0.84 |
| Toner leakage | x | x | x | ○ | ○ | ○ |

The results for Comparative Examples 1 to 3 shown in Table 2 indicate that, where the friction coefficient of the opposite end regions 5*a* of the outer peripheral surface 5 is greater than 0.15, the wear resistance of the opposite end regions 5*a* is insufficient and the toner leakage from the opposite end regions 5*a* occurs during repeated image formation.

On the other hand, the results for Examples 1 to 3 indicate that, where the friction coefficient of the opposite end regions 5*a* is reduced to not greater than 0.15 by the irradiation of the opposite end regions 5*a* with the ultraviolet radiation or by the formation of the coating layer, the wear resistance of the opposite end regions 5*a* is improved to prevent the toner leakage from the opposite end regions 5*a* during the repeated image formation.

Example 4

A semiconductive rubber composition was prepared in substantially the same manner as in Example 1, except that the rubber component was prepared by blending 50 parts by mass of ECO (EPICHLOMER (registered trade name) D available from Tosoh Corporation and having an ethylene oxide content of 61 mol %), 30 parts by mass of CR (SHOPRENE (registered trade name) WRT available from Showa Denko K.K.) and 20 parts by mass of NBR (higher- and intermediate-acrylonitrile-content nitrile rubbers Nipol (registered trade name) 401LL available from Zeon Corporation). A roller body 2 and then a developing roller 1 were produced in substantially the same manner as in Example 1 by employing the semiconductive rubber composition thus prepared.

The opposite end regions 5*a* of the developing roller 1 each had a friction coefficient of 0.14 as measured by the method previously described. A developing function region of the outer peripheral surface 5 not irradiated with the ultraviolet radiation had a friction coefficient of 0.85 as measured in the same manner.

Comparative Example 4

A developing roller 1 was produced in substantially the same manner as in Example 4, except that no oxide film 7 was formed on the opposite end regions 5*a* of the roller body 2 by the irradiation with the ultraviolet radiation.

The opposite end regions 5*a* and the developing function region of the outer peripheral surface 5 of the roller body 2 each had a friction coefficient of 0.85.

Example 5 and Comparative Examples 5 and 6

Developing rollers 1 were each produced in substantially the same manner as in Example 4, except that the UV irradiation periods during which the opposite end regions 5*a* of the roller body 2 were irradiated with the ultraviolet radiation after each rotation of the roller body 2 were set to 1 minute (Comparative Example 5), 5 minutes (Comparative Example 6) and 15 minutes (Example 5).

The friction coefficients of the opposite end regions 5*a* of the outer peripheral surfaces 5 of the roller bodies 2 were 0.74 (Comparative Example 4), 0.16 (Comparative Example 5) and 0.09 (Example 5). The friction coefficients of the developing function regions of the outer peripheral surfaces 5 other than the opposite end regions 5*a* were 0.85 in Example 5 and Comparative Examples 5 and 6.

Example 6

A developing roller 1 was produced in substantially the same manner as in Example 4, except that, instead of the irradiation of the opposite end regions 5*a* of the roller body 2 with the ultraviolet radiation, a coating layer was formed by using the same coating agent as in Example 3.

The opposite end regions 5*a* of the developing roller 1 had a friction coefficient of 0.10 as measured by the aforementioned method. The developing function region of the outer peripheral surface 5 not coated with the coating layer 7 had a friction coefficient of 0.85 as measured by the aforementioned method.

The developing rollers 1 produced in Examples and Comparative Examples were evaluated for the wear resistance. The results are shown in Table 3.

TABLE 3

| | Comparative Example 4 | Comparative Example 5 | Comparative Example 6 | Example 4 | Example 5 | Example 6 |
|---|---|---|---|---|---|---|
| Treatment | | | | | | |
| UV irradiation period (min) | — | 1 | 5 | 10 | 15 | — |
| Coating layer | Absent | Absent | Absent | Absent | Absent | Present |

TABLE 3-continued

| | Comparative Example 4 | Comparative Example 5 | Comparative Example 6 | Example 4 | Example 5 | Example 6 |
|---|---|---|---|---|---|---|
| Friction coefficient | | | | | | |
| Opposite end regions | 0.85 | 0.74 | 0.16 | 0.14 | 0.09 | 0.10 |
| Other region | 0.85 | 0.85 | 0.85 | 0.85 | 0.85 | 0.85 |
| Toner leakage | x | x | x | ○ | ○ | ○ |

The results for Examples 4 to 6 and Comparative Examples 4 to 6 shown in Table 3 indicate that, even with the semiconductive rubber composition having a different formulation for the roller body 2, substantially the same results as for Examples 1 to 3 and Comparative Examples 1 to 3 are provided.

The results for Comparative Examples 4 to 6 indicate that, where the friction coefficient of the opposite end regions 5*a* of the outer peripheral surface 5 is greater than 0.15, the wear resistance of the opposite end regions 5*a* is insufficient and the toner leakage from the opposite end regions 5*a* occurs during repeated image formation.

On the other hand, the results for Examples 4 to 6 indicate that, where the friction coefficient of the opposite end regions 5*a* is reduced to not greater than 0.15 by the irradiation of the opposite end regions 5*a* with the ultraviolet radiation or by the formation of the coating layer, the wear resistance of the opposite end regions 5*a* was improved to prevent the toner leakage from the opposite end regions 5*a* during the repeated image formation.

This application corresponds to Japanese Patent Application No. 2011-222252 filed with the Japan Patent Office on Oct. 6, 2011, the disclosure of which is incorporated herein by reference.

DESCRIPTION OF REFERENCE CHARACTERS

1: DEVELOPING ROLLER
2: ROLLER BODY
3: HOLE
4: SHAFT
5: OUTER PERIPHERAL SURFACE
5*a*: OPPOSITE END REGIONS
6: SHIELD PLATE
7: OXIDE FILM, COATING LAYER
8: MASKING MEMBER
9: LOAD METER
10: WEIGHT
11: OHP FILM
W: MASS
θ: CONTACT ANGLE
F: LOAD

What is claimed is:

1. A developing roller for use in an electrophotographic image forming apparatus, the developing roller comprising:

a roller body extending in a rotation axis direction thereof and having a cylindrical outer peripheral surface, wherein opposite end regions of the outer peripheral surface of the roller body with respect to the rotation axis direction each have a friction coefficient μ of not greater than 0.15, and wherein another region, other than the opposite end regions, which functions as a developing function region of the outer peripheral surface of the roller body with respect to the rotation axis direction has a friction coefficient μ of 0.84 to 0.85.

2. The developing roller according to claim 1, wherein the friction coefficient μof the opposite end regions of the outer peripheral surface is controlled at not greater than 0.15 by irradiating the opposite end regions of the outer peripheral surface with ultraviolet radiation or by coating the opposite end regions of the outer peripheral surface with a lower-friction coating layer.

3. The developing roller according to claim 2, wherein the opposite end regions have a friction coefficient μ of 0.09 to 0.15.

4. The developing roller according to claim 1, wherein the roller body is formed from epichlorohydrin rubber, styrene-butadiene rubber and a polar rubber.

5. The developing roller according to claim 2, wherein the roller body is formed from epichlorohydrin rubber, styrene-butadiene rubber and a polar rubber.

6. The developing roller according to claim 3, wherein the roller body is formed from epichlorohydrin rubber, styrene-butadiene rubber and a polar rubber.

* * * * *